United States Patent [19]

Brookes

[11] Patent Number: 4,878,664

[45] **Date of Patent: * Nov. 7, 1989**

[54] POKER POOL GAME

[75] Inventor: David L. Brookes, Auckland, New Zealand

[73] Assignee: Development Finance Corporation, Auckland, New Zealand

[ * ] Notice: The portion of the term of this patent subsequent to May 14, 2002 has been disclaimed.

[21] Appl. No.: 664,365

[22] Filed: Oct. 24, 1984

Related U.S. Application Data

[63] Continuation-in-part of Ser. No. 452,729, Dec. 23, 1982, Pat. No. 4,516,770.

[51] Int. Cl.[4] ..... A63D 15/00

[52] U.S. Cl. ..... 273/11 R; 273/59 R; 273/58 G; 273/1 M; 273/3 R

[58] Field of Search ..... 273/11 C, 11 R, 59 R, 273/58 G, 1 E, 1 M, 2, 3 R, 3 A, 4 R, 118 A, 119 A; 340/323 R

[56] References Cited

U.S. PATENT DOCUMENTS

| | | | |
|---|---|---|---|
| 3,680,859 | 8/1972 | English | 273/59 R |
| 4,116,435 | 9/1978 | Sines et al. | 273/11 R |
| 4,140,220 | 2/1979 | Hazeltine et al. | 273/11 R |
| 4,355,802 | 10/1982 | Sargent | 273/11 R |
| 4,516,770 | 5/1985 | Brookes et al. | 273/11 R |
| 4,524,969 | 6/1985 | Erzmoneit | 273/3 R |

*Primary Examiner*—Maryann Lastova

*Attorney, Agent, or Firm*—Young & Thompson

[57] ABSTRACT

A pool game uses balls marked to correspond to standard playing cards. Each player or team attempts to form a "poker hand" by sinking appropriate balls, to defeat the opponent's hand. Typically, an electronic scoring apparatus detects each ball as it is potted, and displays the state of each player's "hand".

2 Claims, 2 Drawing Sheets

POKER POOL GAME

This application is a continuation-in-part of copending application Ser. No. 452,729 filed Dec. 23, 1982, now U.S. Pat. No. 4,516,770.

BACKGROUND OF THE INVENTION

This invention relates to an electronically operated table game, and to its method of operation.

In the standard game of Pool, known also as Kelly Pool, there are sixteen balls, including the cue ball. The fifteen non-cue balls are numbered consecutively, and fall into two group known as "unders" (under 8) and "overs" (over 8). Each player, or team, attempts to pot all of his/her/its balls, and then the "wild" ball (the 8) ahead of the other player or team.

In an electronic scoring version of the game (as described for example in U.S. Pat. No. 4,516,770, the disclosure of which is incorporated herein by way of reference), each of these balls must be individually identified electronically, as well as being visually distinguishable.

It is an object of the present invention to provide an alternative game to the electronic version of Kelly Pool.

SUMMARY OF THE INVENTION

The following is a description of the invention, given with reference to the accompanying drawings in which.

Figure 1:
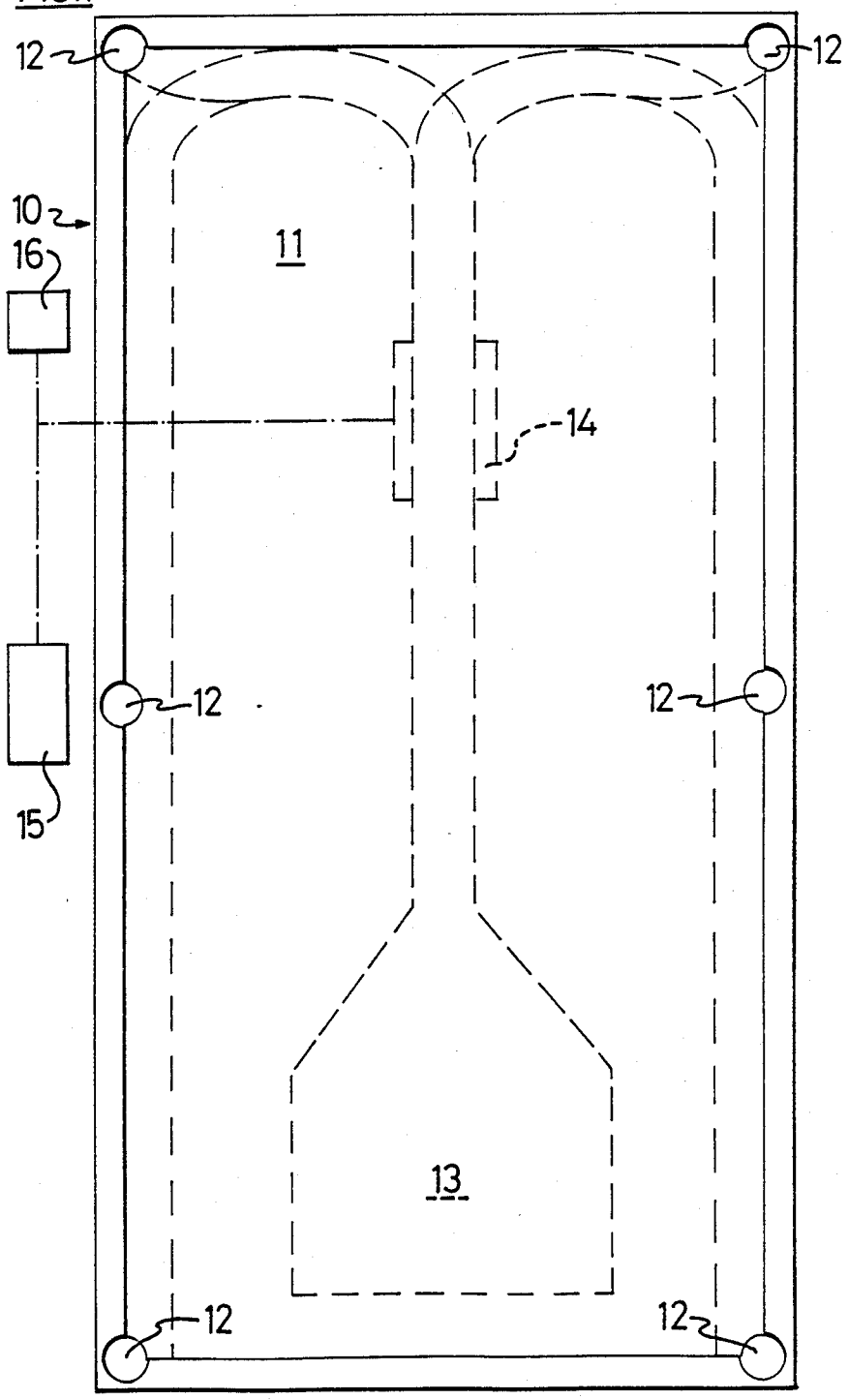
FIG. 1 illustrates a preferred table of the present invention in plan view.
Figure 2:
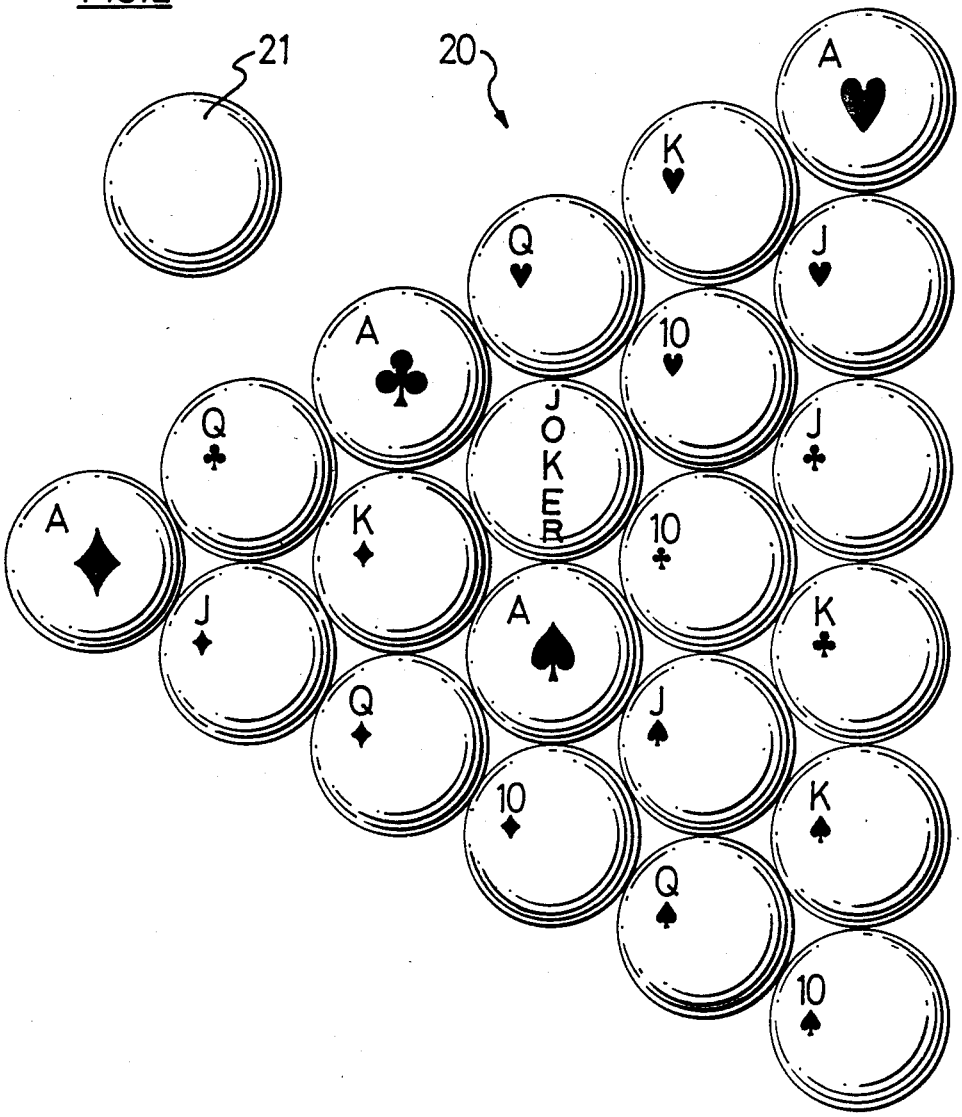
FIG. 2 illustrates preferred balls of the present invention.

In a first aspect, the present invention broadly consists in a table ball game comprising a playing surface 11 and ball traps 12, electronic detection means 14 associated with one or more of the ball traps, a plurality of visually distinguishable balls 20 having electronic identification means associated therewith capable of being detected by said electronic detection means, said electronic detection means being coupled to scoring means 16 to record the entry of balls into said ball 21, traps, wherein the balls, other than a "cue ball", are marked to correspond to card values as in a standard pack of playing cards.

Preferably, there is an indicator panel 15 operatively connected to said electronic detection means, for indicating the balls pocketed by each player or team.

The above gives a broad description of the present invention, a preferred form of which will now be described by way of example.

DESCRIPTION OF THE PREFERRED EMBODIMENT

The preferred game of the present invention is "Poker Pool", in which there are twenty-two balls. Twenty of these are marked to correspond to the five highest cards of each of the four suits of a standard set of playing cards. Another is marked to correspond to the "joker", and one ball is the "cue" ball, typically a plain white ball, although not necessarily.

Our U.S. Pat. No. 4,516,770 referred to above, describes a means of electronically identifying a number of different balls, typically twenty-one of them.

At the commencement of a game, each player or team leader typically enters his name or code on a keyboard and electronic display on a wall unit, to book a turn at the table 10. The entry is acknowledged electronically, and the position in the current queue is indicated.

Each time the table 10 is vacated, the board audibly calls the next players, displaying their names or codes on a display unit 15. If the players called do not respond (typically by inserting coins) within a predetermined time, the next group of players is called.

The coins are monitored and, when the correct amount has been inserted, the balls 20 are dropped into a tray 13 for placing on the table 10.

Typically, the balls are designated as follows:

| Visual Marking | | Electronic Identification |
|---|---|---|
| Hearts | 10 | 1 |
| | J | 2 |
| | Q | 3 |
| | K | 4 |
| | A | 5 |
| Diamonds | 10 | 6 |
| | J | 7 |
| | Q | 8 |
| | K | 9 |
| | A | 10 |
| Clubs | 10 | 11 |
| | J | 12 |
| | Q | 13 |
| | K | 14 |
| | A | 15 |
| Spades | 10 | 16 |
| | J | 17 |
| | Q | 18 |
| | K | 19 |
| | A | 20 |
| Joker | | 21 |
| Cue Ball | | None |

Each team takes turns to pocket balls selectively in such a way as to gain a "poker hand", or to prevent their opponent(s) from doing so. The Joker is a "wild" ball, and is to be pocketed at the completion of the "hand".

The cue ball 21 is returned whenever pocketed, and has no effect on the score.

Whenever a ball 20 is pocketed, a corresponding indicator panel on the wall display unit 15 is lit, typically in a group of indicators associated with the respective player or team. Each group of indicators is laid out in a formation in which suits are grouped together, with graphical display of the corresponding card alongside, e.g.:

| | | | | | |
|---|---|---|---|---|---|
| SPADE | 10 | J | Q | K | A |
| CLUB | 10 | J | Q | K | A |
| DIAMOND | 10 | J | Q | K | A |
| HEART | 10 | J | Q | K | A |
| | | | JOKER | | |

This display could be in the form of an illuminated board or panel

An alternative indicator panel involves the use of electronically controlled flip cards, each card being provided with an appropriate pattern or graphics to represent a designated playing card corresponding to a respective one of the balls, so that when that particular ball is pocketed, the ball will be recognised by the detector electronics 14, which will then cause the appropriate flip card to flip over, presenting the appropriate picture indicating that that ball has been scored.

To ensure that the correct group of indicators is actuated (i.e., the group relating to the current player or team), one or other of two "TEAM SELECT" buttons is pushed at the commencement of each player's or team's turn.

In serious games, however, a referee will be appointed to attend to this function, together with rule interpretation, but for casual games players will normally monitor this for themselves.

Various modifications to the above may be made without departing from the scope of the present invention as broadly claimed or envisaged.

I claim:

1. A table ball game comprising a playing surface and ball traps, electronics detection means associated with one or more of the ball traps, a plurality of visually distinguishable balls having individually distinct electronic identification means associated therewith capable of being detected and individually distinguished from each other by said electronic detection means, said electronic detection means being coupled to scoring means to record the entry of balls into said ball traps, wherein the balls, other than a "cue ball", are marked with numbers or letters, and also with symbols, that correspond to card values in a standard pack of playing cards.

2. A table ball game as claimed in claim 1, wherein there is an indicator panel operatively connected to said electronic detection means, for identifying the balls pocketed by each player or team.

* * * * *